US008103802B2

(12) United States Patent
Lay et al.

(10) Patent No.: US 8,103,802 B2
(45) Date of Patent: Jan. 24, 2012

(54) PORTABLE DATA SYSTEM

(75) Inventors: Frank Lay, Taipei (TW); Cheng-Wen Yang, Hacienda Heights, CA (US); Lavetta Willis, Los Angeles, CA (US)

(73) Assignee: LL International Shoe Company, Los Angeles, CA (US)

( * ) Notice: Subject to any disclaimer, the term of this patent is extended or adjusted under 35 U.S.C. 154(b) by 68 days.

(21) Appl. No.: 12/009,271

(22) Filed: Jan. 17, 2008

(65) Prior Publication Data

US 2008/0167741 A1 Jul. 10, 2008

Related U.S. Application Data

(63) Continuation-in-part of application No. PCT/US2006/045746, filed on Nov. 29, 2006.

(60) Provisional application No. 60/794,945, filed on Apr. 26, 2006, provisional application No. 60/740,500, filed on Nov. 29, 2005.

(51) Int. Cl.
*G06F 3/00* (2006.01)

(52) U.S. Cl. ..... 710/2; 710/7; 36/1; 36/132

(58) Field of Classification Search ..... None
See application file for complete search history.

(56) References Cited

U.S. PATENT DOCUMENTS

| | | | | |
|---|---|---|---|---|
| 4,771,556 | A | 9/1988 | Kim | |
| 5,402,590 | A | 4/1995 | Lee | |
| 5,530,626 | A | 6/1996 | Norment | |
| 5,615,111 | A * | 3/1997 | Raskas et al. | 36/136 |
| 5,765,300 | A * | 6/1998 | Kianka | 36/139 |
| 5,930,026 | A | 7/1999 | Jacobson et al. | |
| 6,000,149 | A | 12/1999 | Pomerantz | |
| 6,018,705 | A | 1/2000 | Gaudet et al. | |
| 6,052,654 | A | 4/2000 | Gaudet et al. | |
| 6,122,340 | A | 9/2000 | Darley et al. | |
| 6,298,314 | B1 | 10/2001 | Blackadar et al. | |
| 6,493,652 | B1 | 12/2002 | Ohlenbusch et al. | |
| 6,498,994 | B2 | 12/2002 | Vock et al. | |
| 6,557,271 | B1 | 5/2003 | Weaver, III | |
| 6,585,622 | B1 | 7/2003 | Shum et al. | |
| 6,611,789 | B1 | 8/2003 | Darley | |
| 6,788,200 | B1 * | 9/2004 | Jamel et al. | 340/539.13 |
| 6,876,947 | B1 | 4/2005 | Darley et al. | |
| 6,882,955 | B1 | 4/2005 | Ohlenbusch et al. | |
| 6,898,550 | B1 | 5/2005 | Blackadar et al. | |
| 7,171,331 | B2 | 1/2007 | Vock et al. | |
| 2002/0167483 | A1 * | 11/2002 | Metcalf | 345/156 |
| 2006/0020421 | A1 | 1/2006 | Darley et al. | |
| 2007/0060135 | A1 * | 3/2007 | Lin | 455/445 |
| 2009/0104940 | A1 * | 4/2009 | Seshadri et al. | 455/563 |

OTHER PUBLICATIONS

The "Electronic Shoe" for Jogging, Sports and Reconvalescence, Heinz Gerhauser and Gerhard Pirner, IEEE, 1989, pp. 1-3.*

* cited by examiner

*Primary Examiner* — Eron J Sorrell
(74) *Attorney, Agent, or Firm* — Greer, Burns & Crain, Ltd.

(57) ABSTRACT

A data system includes an article such as footwear, model car or toy, an electronic module carried by said article, the electronic module having a microprocessor and a data storage device to which the user can selectively store and retrieve data, a data input to the electronic module configured for the user to input and store data on the data storage device, a controller in electronic communication with the electronic module for controlling data output, and an audio output device in electronic communication with the electronic module for receiving data output from the electronic module.

5 Claims, 10 Drawing Sheets

PORTABLE DATA SYSTEM

CROSS-REFERENCE

This application is a continuation-in-part of Patent Cooperation Treaty Application No. PCT/US2006/045746 designating the United States filed Nov. 29, 2006, which claims priority from U.S. Provisional Patent Application No. 60/794,945 filed Apr. 26, 2006 and U.S. Provisional Patent Application No. 60/740,500 filed Nov. 29, 2005.

BACKGROUND OF THE INVENTION

The present invention relates to a portable and wireless data system, and more particularly, for such a data system for use in a variety of articles, such as footwear, clothing and novelty items.

Portable data systems such as MP3 players, compact disc players, digital audio players, heart monitors and GPS navigation systems are well known in the art. Portable systems allow the user to travel almost anywhere and still be able to utilize the system. Generally, these systems are relatively lightweight and small in size, so that they can be carried by the user or placed in a pocket or on a belt or armband.

However, despite their relatively small size, current data systems can still be bulky when placed in the user's pocket or on a belt. If hand held, the data system can be dropped and damaged. Further, such data systems are generally separately manufactured, and accordingly, the user might have to carry multiple portable devices at the same time in order to listen to music, monitor heart rate, and find directions to a specific location, for example. In addition, with respect to music players and other audio data systems, they generally provide sound only through headset speakers, rather than external speakers, so the user is the only person that can hear the audio output.

SUMMARY OF THE INVENTION

Accordingly, the present invention provides a portable and wireless data system incorporated into various items such as an article of footwear, an article of clothing, and/or a novelty item. The present data system is small enough to be contained within the article itself, without adding significant weight to the article or objectionable bulk. The present data system allows the user to travel without having to carry multiple audio and data devices. Further, the present data system allows the user the option to either use external speakers located on the article, or headset speakers, depending on whether the user wants to publicly or privately listen to the audio content. In addition, the present data system contains components that are removable from the article and allow the system to be easily replaced when necessary.

The present invention provides a portable, wireless data system for use in various articles that is lightweight, relatively small in size compared to current systems, that allows for external or internal speakers, depending on the user's desire, and that can be entirely carried by the article.

More specifically, in one embodiment, the present invention provides a data system including at least one shoe, an electronic module carried by the shoe, the electronic module having a microprocessor and a data storage device to which the user can selectively store and retrieve data, a data input to the electronic module configured for the user to input and store data on the data storage device, a controller in electronic communication with the electronic module for controlling data output, and an output device in electronic communication with the electronic module for receiving data output from the electronic module.

In another embodiment, the present invention provides a data system for an article of footwear, including a first shoe and a second shoe. The first shoe includes a first electronic module having a first microprocessor, a data storage device in electronic communication with the first microprocessor, and a first wireless data link. The first microprocessor and the first data link can be physically a single component like ASIC or system on a chip or multiple components. The second shoe includes a second electronic module having a second wireless data link receptive of data from the first electronic module. The data system further includes a first audio speaker carried by the first shoe and in electronic communication with the first electronic module, and a second audio speaker carried by the second shoe and in electronic communication with the second electronic module.

In yet another embodiment, the present invention provides a data system for a novelty item such as a model car or toy. The data system for the model car or toy includes an electronic module carried in the car and including a microprocessor, a data storage device to which the user can selectively store and retrieve data, a data input to the electronic module configured for the user to input and store data on the data storage device, a first wireless data link and an audio output device. The foregoing can be multiple components or a single integrated chip. A display module and a controller are in electronic communication with the electronic module.

For users that wish to privately listen to the audio provided by the present data system, a headset is provided that is in wireless communication with the first data link.

Accordingly, the present data system provides for data storage of any digital sort, such as a digital music player, heart monitor, workout profiler and GPS navigation system. Further, in the footwear embodiment, the present data system allows the user to obtain heart monitor or navigation data while listening to music.

DETAILED DESCRIPTION OF THE INVENTION

Figure 1:
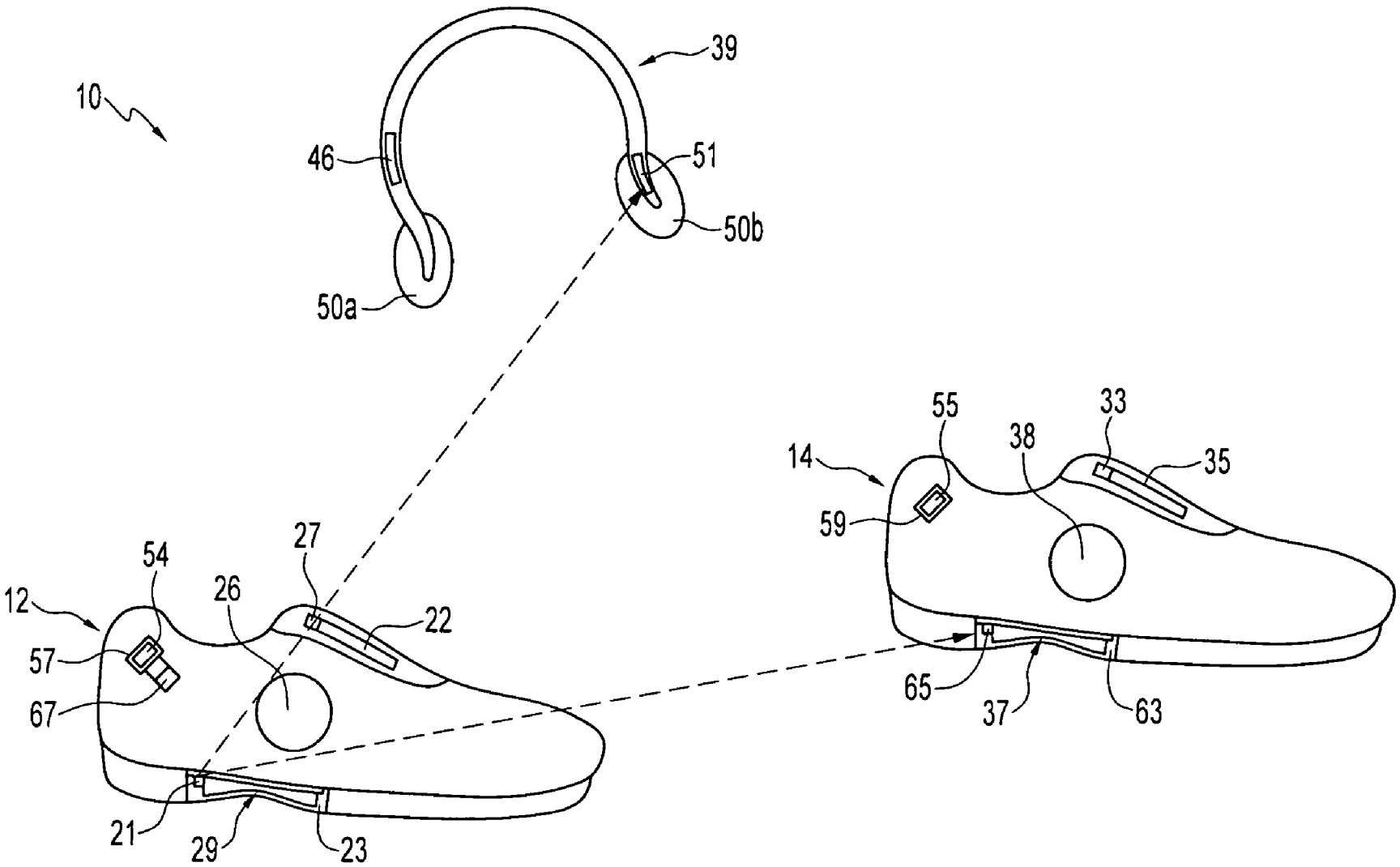
FIG. 1 is a schematic of a data system according to the present invention.
Figure 2:
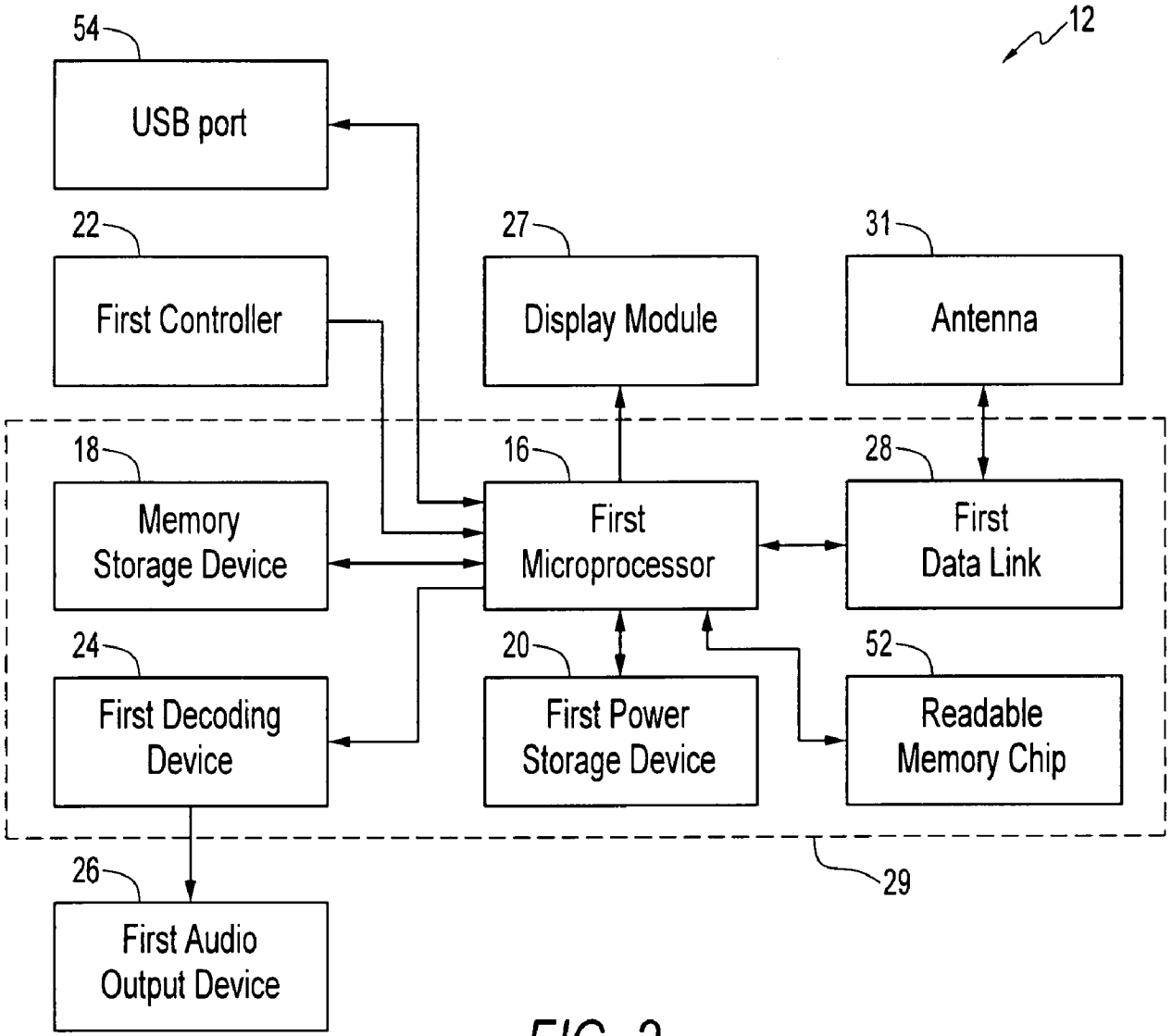
FIG. 2 is a logic diagram showing the components of a first embodiment of the data system.

Referring to FIGS. 1 and 2, a data system for an article is provided and generally designated 10. The article can be essentially any useful article such as footwear, clothing, novelty item or toy. The data system of the invention has particular applicability to footwear as shown if FIG. 1 and described below. The article includes a pair of shoes, consisting of a first shoe 12 and a second shoe 14. The data system carried by first shoe 12 includes a first microprocessor 16, a data storage device 18 in electronic communication with the first microprocessor, a first power storage device 20 in electronic communication with the first microprocessor, a first controller 22 in electronic communication with the first microprocessor, a first decoding device 24 in electronic communication with the first microprocessor, an output device such as a first audio output device 26 in electronic communication with the first decoding device, an optional display module 27 in electronic communication with the first microprocessor, and an optional first data link 28 in electronic communication with the first microprocessor.

It is recognized that the forgoing devices or functional blocks might be separate devices as illustrated, or alternatively, multiple devices can be integrated in a single component, such as a system on a chip. It should be understood, therefore, that the depiction and description of separate devices is merely one embodiment of the invention and should not be construed as limiting the invention or foreclosing the integration of such devices or functional blocks.

Although not required, a read only memory ("ROM") chip 52 is preferably provided in electronic communication with microprocessor 16. It is preferred but not required, that the first microprocessor 16, memory storage device 18, first power storage device 20, first decoding device 24 and first data link 28 are housed together as a single first electronic module 29. It is further preferred that the first module 29 is removable from the shoe 12. The electronic module 29 further includes a connector 21 preferably located towards the heel of the shoe 12 for receiving a mating wire harness connector, which will be described in further detail below.

Figure 8:
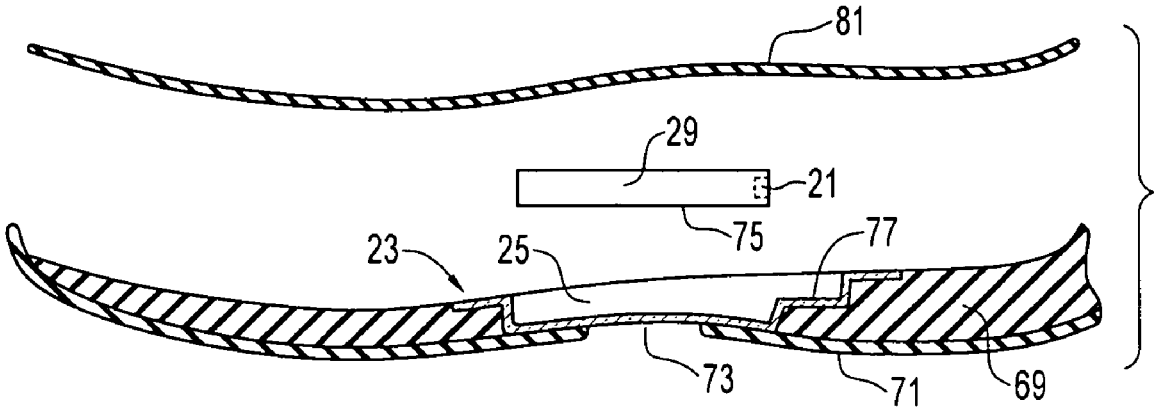
FIG. 8 is an exploded longitudinal cross-section of a shoe sole showing an electronic module received within a shank member.

Preferably still, the first module 29 is carried within a shank member 23 provided in an arch region 69 of the sole structure of the shoe 12 and as shown in FIG. 8. The shank 23 is preferably manufactured from a lightweight, durable, transparent plastic and defines a cavity 25 for receiving the electronic module 29. The shank 23 stiffens the sole structure of the shoe 12, fixes the position of the electronic module 29 and protects the module from damage due to impact and vibration. Preferably, an opening 73 is provided in outsole 71 through which the electronic module 29 can be seen. A bottom surface 75 of the electronic module 29 further includes an external LED (not shown) that indicates to the user whether the module needs to be recharged. For example, a red LED would indicate that the module 29 needs to be recharged, and a green LED would indicate that the module is fully charged, although other configurations may be suitable. The shank 23 preferably further includes a step 77 within the cavity 25 configured for receiving the wire harness connector. Alternatively, the first module 29 could be located in another portion of the shoe 12, e.g., the heel or lateral quarter.

The microprocessor 16 is preferably a micro control unit (MCU). The memory storage device 18 can be flash memory, mini hard drive, data player disc or memory card, all of which are generally available in the industry. The ROM chip 52 is preferably an EEPROM chip, which is generally available in the industry. ROM chip 52 stores firm code, program files, parameters and identification data. The optional first data link 28 can be wired or wireless. Preferably data link 28 is a functional module which connects to the microprocessor 16 by an industry standard interface. A system on chip ("SoC") is preferred for the data link module. The data link protocol for the "SoC" can be proprietary or industry standard such as Bluetooth or GSM system, for example. To provide an improved audio reception, an optional antenna 31 is connected to the first data link 28.

Optional display module 27 is preferably an LCD or an LED display, as known in the art. Preferably still, display module 27 is removably located on the shoe 12, such as the tongue, as shown in FIG. 1, although it is appreciated that other locations may be suitable.

As known in the art, the first controller 22 preferably includes a plurality of command buttons, such as play, pause, stop, forward, and reverse. It is preferred that the first controller 22 can be any shape, such as a square, oval, circle, rectangle, or the like. It is contemplated that the first controller 22 can be at any one of several locations on the first shoe 12, such as the medial or lateral quarter, tongue, or toe box, but it is preferred that the controller be located on the tongue or medial quarter of the shoe, as shown in FIG. 1.

Alternatively, the controller 22 and/or display module 27 can be located remotely from the shoe 12, for example, on an audio headset as described below, or a wrist band. If the controller is located remotely, it is preferable connected to the microprocessor via a wireless data link.

By the term "input device" we mean any device that inputs data to the microprocessor, including a USB or other port hard wired to the first microprocessor, a wireless data link, a read only memory chip or a GPS Module. By the term "output device" we mean any device that outputs data from the microprocessor, including a USB or other port hard wired to the first microprocessor, a wireless data link, an audio output device such as one or more speakers, or a visual display.

Figure 9:
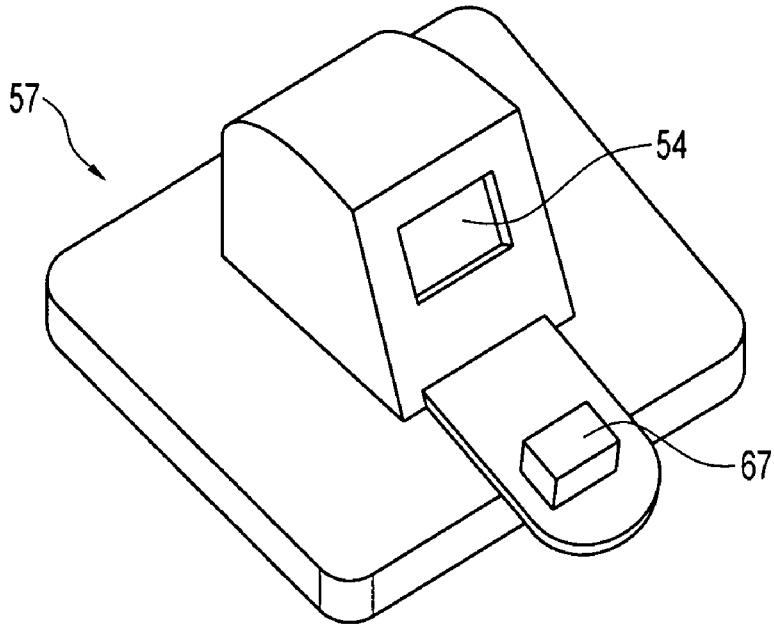
FIG. 9 is an enlarged perspective view of a USB port provided on an article of footwear in accordance with the present data system.

The first embodiment data system operates as follows: data input or USB port 54 provides data and power connection to first electronic module 29. The USB port 54 can be placed in several locations on the shoe 12, such as the heel, tongue, medial or lateral quarters, but is preferably arranged on the lateral quarter. USB port 54 also provides an operative electronic connection to another computing device such as a personal computer, a personal digital assistant (PDA) or cellular phone, as explained below. Preferably and as shown in FIGS. 1 and 9, the USB port 54 is carried within a USB port holder 57 which extends outwardly from the upper lateral quarter of the shoe 12. The port holder 57 is preferably manufactured from a water-resistant nylon material, and surrounds the USB port 54, which is preferably slanted outwardly within the holder to provide an easy and secure connection. To further minimize exposure to moisture, an optional rubber stopper 67 is attached to the port holder 57 and configured for covering the port 54 when not in use. However, it is appreciated that other devices for protecting the USB port 54 could be provided.

Electrical power is stored in power storage device 20, which provides power to microprocessor 16, which is the heart of the first module 29, and to all other powered components within first shoe 12. Data, such as MP3 music files for example, can be downloaded to the unit via port 54 or wirelessly through the antenna 41 and the first data link 28 and stored in memory storage device 18. Program files, such as MP3 music player software, is preferably permanently recorded and stored in ROM chip 52.

To operate the data system 10 the user presses the proper command on the first controller 22, which transmits the desired operation to the first microprocessor 16. At this point, digital program and data files stored in ROM 52 and/or memory storage device 18 are loaded into the first microprocessor 16. Output from the microprocessor 16 is directed to either first decoding device 24 or data link 28, as desired. When data is output to first decoding device 24, it is decoded into audio format, and sent to the first audio output device 26, or speaker, mounted in the first shoe 12. In addition, or alternatively, the output data may be sent to the first data link 28 and wirelessly communicated to another device, as will be explained in greater detail relative to the other embodiments. The basic first embodiment can be adapted to any one or more functions, including but not limited to, data storage, digital music player, heart rate monitor, work out profile, navigation and child finder, as will be explained in greater detail below in reference to exemplary embodiments two through six.

Preferably, connections within the shoe 12 are made by a wire harness which is permanently incorporated within the shoe (not shown). The wire harness includes a connector at one end for providing a connection to the first electronic module 29 at mating connector 21. Preferably, three leads extend from the wire harness and provide connections to the USB port 54, first audio output device 26, and controller 22, respectively. In the event of damage to the module 29, the module can be detached from the wire harness and replaced. Further, if the shoe 12 becomes worn out or damaged, the module 29 can be detached from the wire harness and removed to a new shoe. To remove the electronic module 29, the user removes a footbed 81 from within the shoe, detaches the module 29 from the wire harness and removes the module from the shank cavity 25. (FIG. 8). It is also contemplated that the USB port 54 and first audio output device 26 can be provided within the electronic module 29 to provide a single and compact unit that is removable from the shoe 12.

Figure 3:
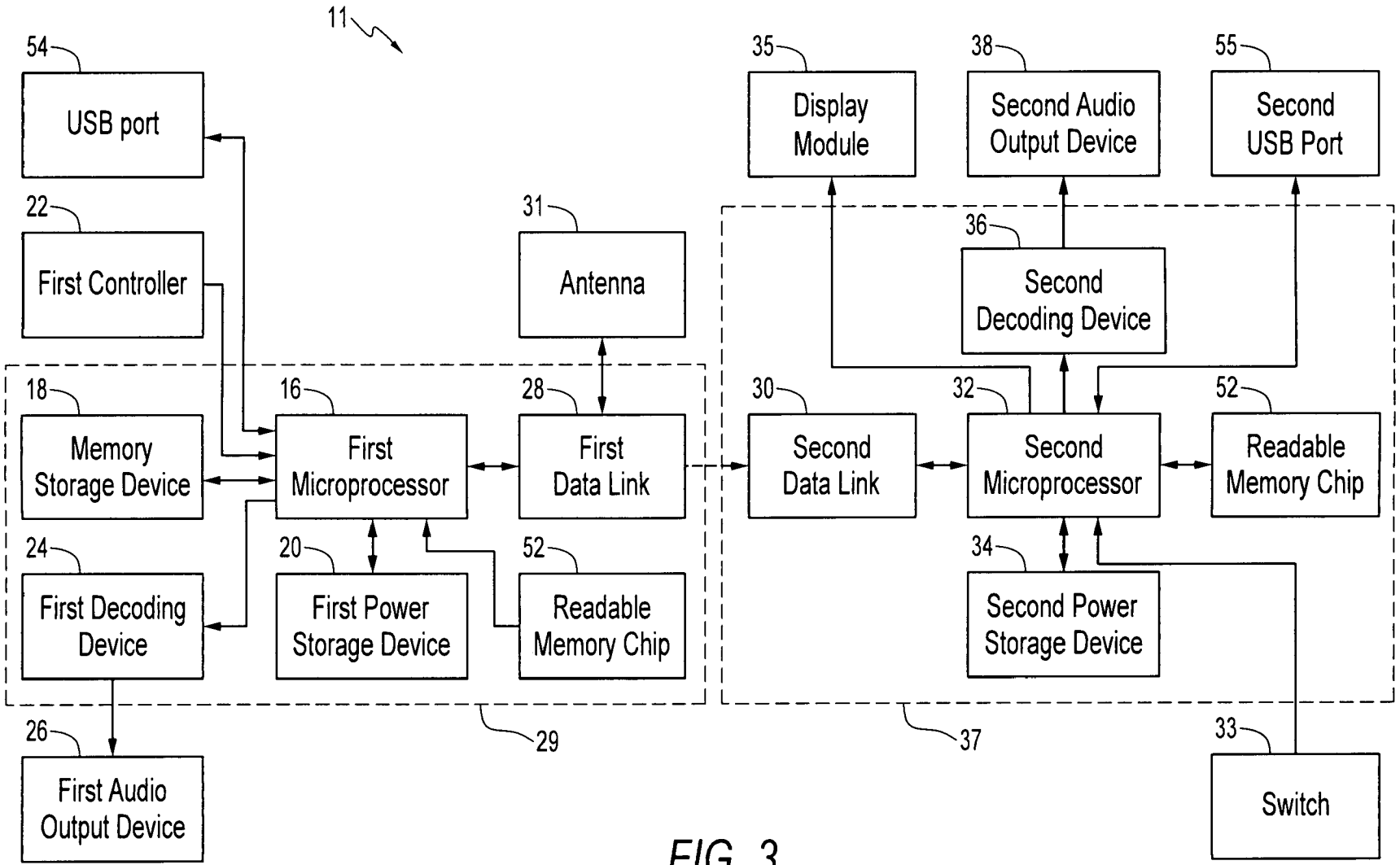
FIG. 3 is a logic diagram showing a second embodiment of the data system comprising a first shoe data unit in communication with a second shoe data unit.

As shown in FIG. 3, a second embodiment of the data system is designated 11 and comprises the first electronic module 29 as described above carried by first shoe 12, and a second electronic module 37 carried by a second shoe 14 of the pair. Second module 37 comprises a second data link 30 in wireless communication with the first data link 28, a second microprocessor 32 in electronic communication with the second data link, a switch 33 in electronic communication with the second microprocessor, a second power storage device 34 in electronic communication with the second microprocessor and all other powered components in second shoe 14, an optional display module 35 in electronic communication with the second microprocessor, a second decoding device 36 in electronic communication with the second microprocessor, and a second audio output device 38 in electronic communication with the second decoding device.

Similar to the first electronic module 29, the second data link 30, second microprocessor 32, second power storage device 34 and second decoding device 36 are preferably housed together in the second electronic module 37 that is removable from the second shoe 14 and that can be located in any suitable place within the shoe, most preferably the arch. Similar to the first electronic module 29 described above with respect to FIG. 8, the second electronic module 37 is carried within a cavity 61 of a second shank 63, provided in the arch region of shoe 14. The second electronic module further includes a connector 65 for receiving a mating wire harness connector, the connector 65 preferably being located towards the heel of the shoe 14, as shown in FIG. 1.

A second data input or USB port 55 provides power connection to the second electronic module 37, and can be placed in several locations on the shoe 14, such as the heel, tongue, back tab, medial or lateral quarters, but is preferably arranged on the lateral quarter (FIG. 1). The second USB port 55 is preferably carried in a second USB port holder 59, which is arranged in a similar configuration to the holder 57 described above and shown in FIG. 9, to minimize moisture exposure. However, it is recognized that other configurations may be appropriate.

The second embodiment 11 operates in a similar way as the first. To enable wireless transmission from first data link 28 to the second data link 30, the second microprocessor 32 and the second decoding device 36, the user first activates the switch 33 to the "on" position. After transmission, the data is decoded from digital to analog and sent to the second audio output device 38, or speaker, of the second shoe 14. Music can then externally be heard in stereo through the first and second audio output devices 26, 38, the first shoe speaker playing left channel and the second shoe speaker playing right channel, or vice versa. Upon successful transmission of the data to the second audio output device 38, an acknowledgement is sent back to the first microprocessor 16. It is contemplated that the first and second electronic modules 29, 37 include corresponding identification numbers, ensuring that the units only communicate with each other.

Similar to the shoe 12, connections within the shoe 14 are made by a second wire harness permanently integrated within the shoe (not shown). The second wire harness has a connector at one end configured to mate with connector 65 of the second electronic module 37. Three leads extend from the second wire harness and provide connections to the second USB port 55, second audio output device 38, and switch 33, respectively. As stated above with respect to the first module 29, the second module 37 can be detached from the second wire harness and removed from the shoe 14, in the event of damage to the module 37 or the shoe.

Figure 4:
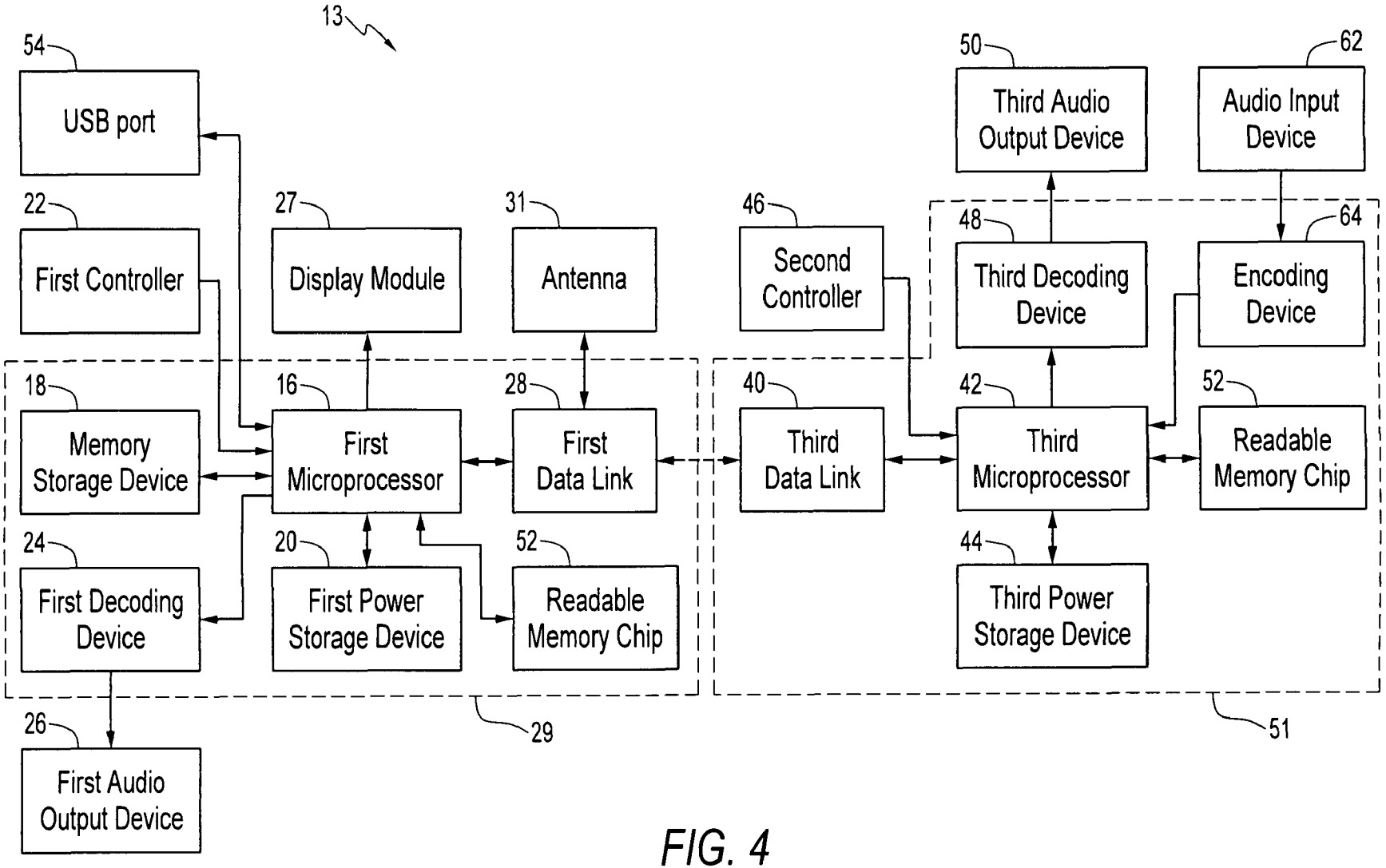
FIG. 4 is a logic diagram showing a third embodiment of the data system showing the first shoe data unit in communication with a headset data unit.

As shown in FIG. 4, a third embodiment of the data system is designated 13 and comprises the first electronic module 29 as described above and a third electronic module 51 that is housed within a headset 39. If a user wishes to privately listen to the data, a headset 39 is utilized, and includes a third data link 40 in wireless communication with the first data link 28, a third microprocessor 42 in electronic communication with the third data link, a third power storage device 44 in electronic communication with the third microprocessor, an optional second controller 46 in electronic communication with the third microprocessor, a third decoding device 48 in electronic communication with the third microprocessor and a third audio output device 50 in electronic communication with the third decoding device. As is known in the art, the third audio output device 50 preferably includes a left headset speaker 50*a* and a right headset speaker 50*b*. The headset 39 includes the third electronic module 51 including the third data link 40, third microprocessor 42, third power storage device 44 and third decoding device 48. The third electronic module 51 is preferably removable from the headset 39 and can be located within the speakers 50*a*, 50*b*, or on the headband portion.

In the third embodiment, the second electronic module 37 and associated outputs shown in FIG. 3 are optional. Further, the first audio output device 26 is optional, i.e., the system of the third embodiment could be utilized with headset speakers 50 comprising the only audio output. The first controller is also optional in the third embodiment, i.e., the microprocessor could be controlled solely by the second controller 46.

If the user wishes to utilize the headset 39, the first and second audio output devices 26, 38 preferably are disabled from audio output. The user presses the appropriate command button on the controller 22 (or second controller 46), sending a signal to the first and second microprocessors 16, 32 that power to the first and second audio output devices 26, 38 should be disabled. The user then presses the appropriate command button on the second controller 46, sending a signal to the third microprocessor 42 that power to the headset 39 should be provided. The second controller 46 can be located anywhere on the headset 39, and can be removable there from for easy use. The files stored in the memory storage device 18 are transmitted to the first microprocessor 16 and then audio output data is sent to the first data link 28, where it is transmitted to the third data link 40. The third data link 40 sends the data to the third microprocessor 42, which sends the data to the third decoding device 48 for conversion from digital to analog audio format. Finally, the audio output is transmitted to the left and right speakers 50*a*, 50*b* of the third audio output device 50.

An audio input device 62 and an encoding device 64 are optionally included in the third electronic module 51. The audio input device 62 is configured for receiving voice data which is encoded by the encoding device 64 into the proper format. The encoded data is then received by the third microprocessor 42, where it is sent to the first microprocessor 16 via the third and first data links 40, 28, respectively. The voice data can then be output from any of the audio output devices, most preferably the speaker 26 and optional speaker 38. Alternatively, the voice data can be digitally stored and/or outputted to another device.

Figure 5:
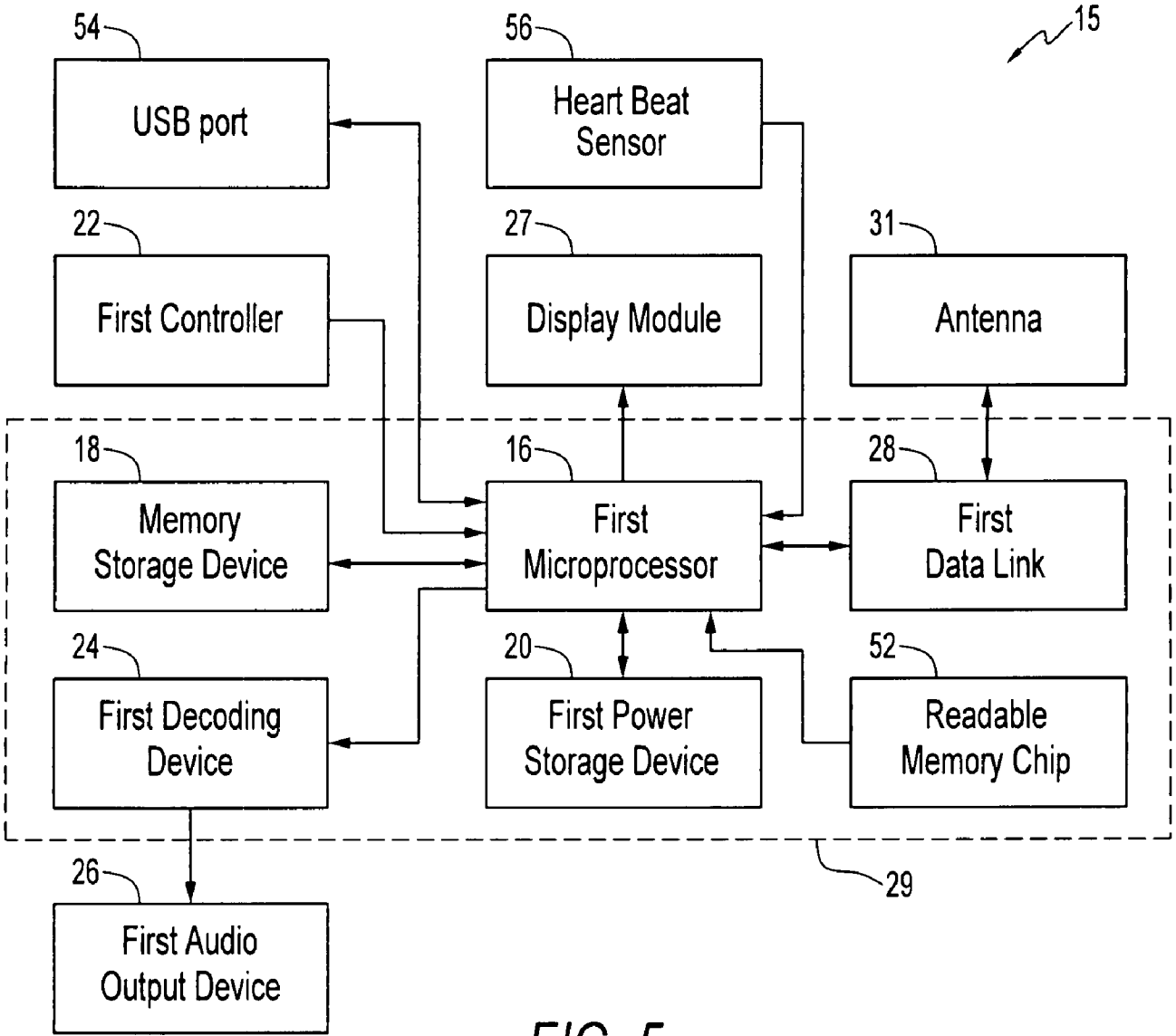
FIG. 5 is a logic diagram showing a fourth embodiment of the data system having a heart monitor.

Referring now to FIG. 5, a fourth embodiment of the data system is designated 15 and comprises the same first electronic module 29 with an added input device, namely a user function sensor 56. Preferably sensor 56 is a heart rate sensor, but other user function sensors (e.g., walking, running, stepping, temperature, blood pressure) could be used in addition to or in lieu of a heart rate sensor. Further, system 15 can be utilized both as a heart rate monitor and a digital music player. In order to provide heart rate readings, the heart rate sensor 56 is provided for attachment to the user. Sensor 56 is in electronic communication with the first microprocessor 16. Once the heart rate is read, the data can either be displayed on display module 27, stored in the memory storage device 18, transmitted via the USB port 54, or wirelessly transmitted via data link 28 to another computing device, such as a personal computer, a heart monitor watch, a personal data assistant, or cell phone. However, it is appreciated that other methods for communicating heart rate data to the user are possible, as are known in the art.

Figure 6:
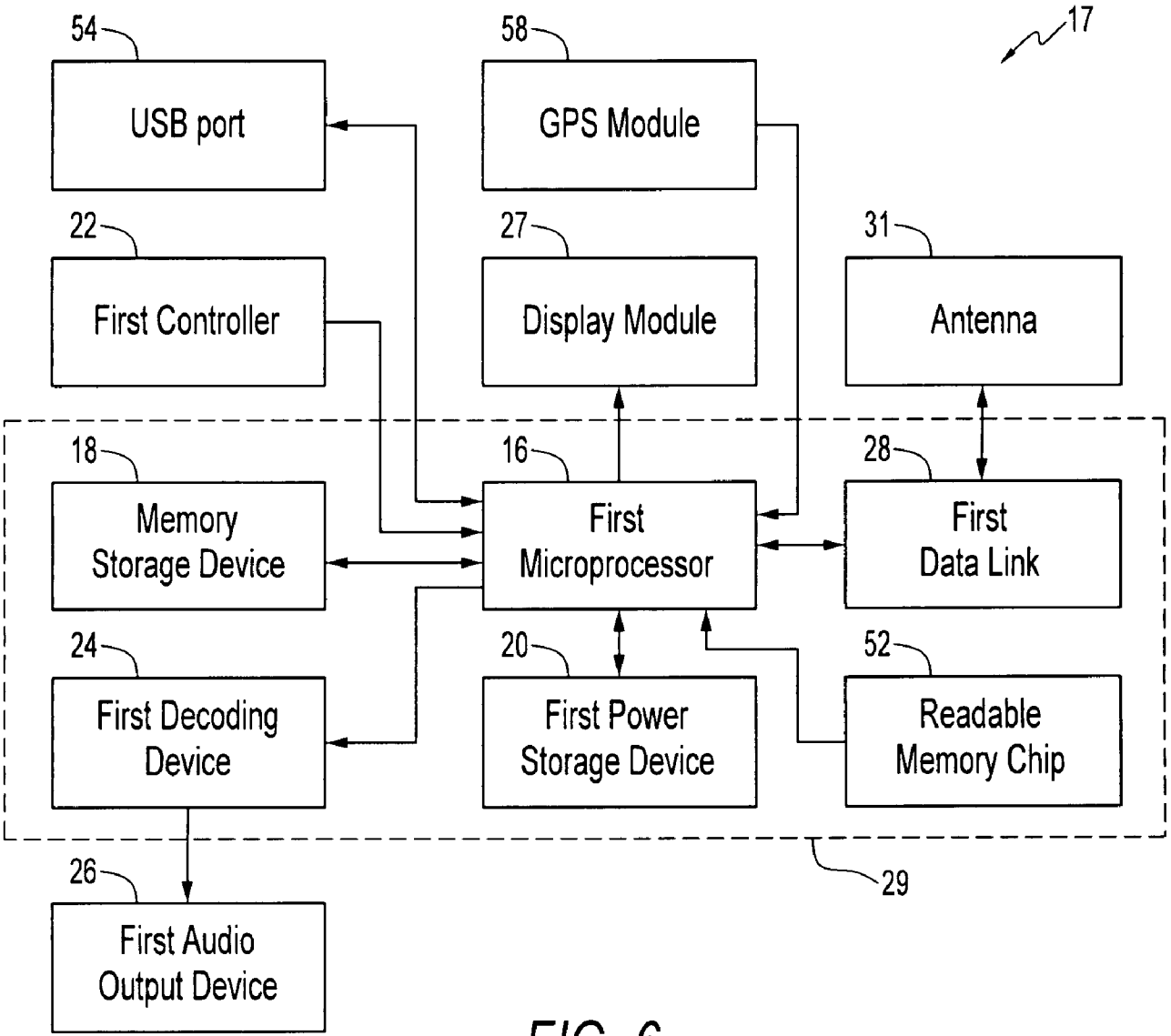
FIG. 6 is a logic diagram showing a fifth embodiment of the data system having a navigation system.

As shown in FIG. 6, a fifth embodiment of the data system 17 includes the first electronic module 29 as described above in combination with a global positioning device ("GPS") 58. System 17 can be utilized for multiple tasks, including but not limited to a navigation system and a digital music player. In accordance with this embodiment, the GPS module 58 is provided and is in electronic communication with the first microprocessor 16. Further, a computer (not shown) is operatively linked to the microprocessor 16 and GPS module 58 either via USB port 54 or the first data link 28. To operate the navigation function, the user first inputs a desired address or location into the computer (not shown). The GPS module 58 provides the current location of the user, which information is uploaded to the computer, which then calculates the user's location and/or route to destination. Preferably, the route data is then downloaded from the computer to the microprocessor 16 via either the USB port 54 or first data link 28. The GPS module 58 continues to transmit the current location of the user to the first microprocessor 16, enabling the data system to determine and plot the user's location with respect to the desired route. The route data can also be transmitted from the first microprocessor 16 to the display module 27, enabling the user to read the route data.

If the user wishes to hear the route data through the first audio output device 26, the data is decoded into the proper format by the first decoding device 24 and sent to the first audio output device. Simultaneously, or alternatively the data can be sent via the first data link 28 to the second data link 30 in the second electronic module 37. The data is then sent to the second microprocessor 32, which sends the data to the second decoding device 36, finally transmitting the data to the second audio output device 38 in the second shoe 14. However, if the user wishes to utilize the headset 39 in order to privately hear the directions, the data signal may be transmitted via the first and third data links 28, 40 to the headset left and right headset speakers, 50*a* and 50*b*. As is known in the art, other ways of transmitting navigational data are possible.

Figure 7:
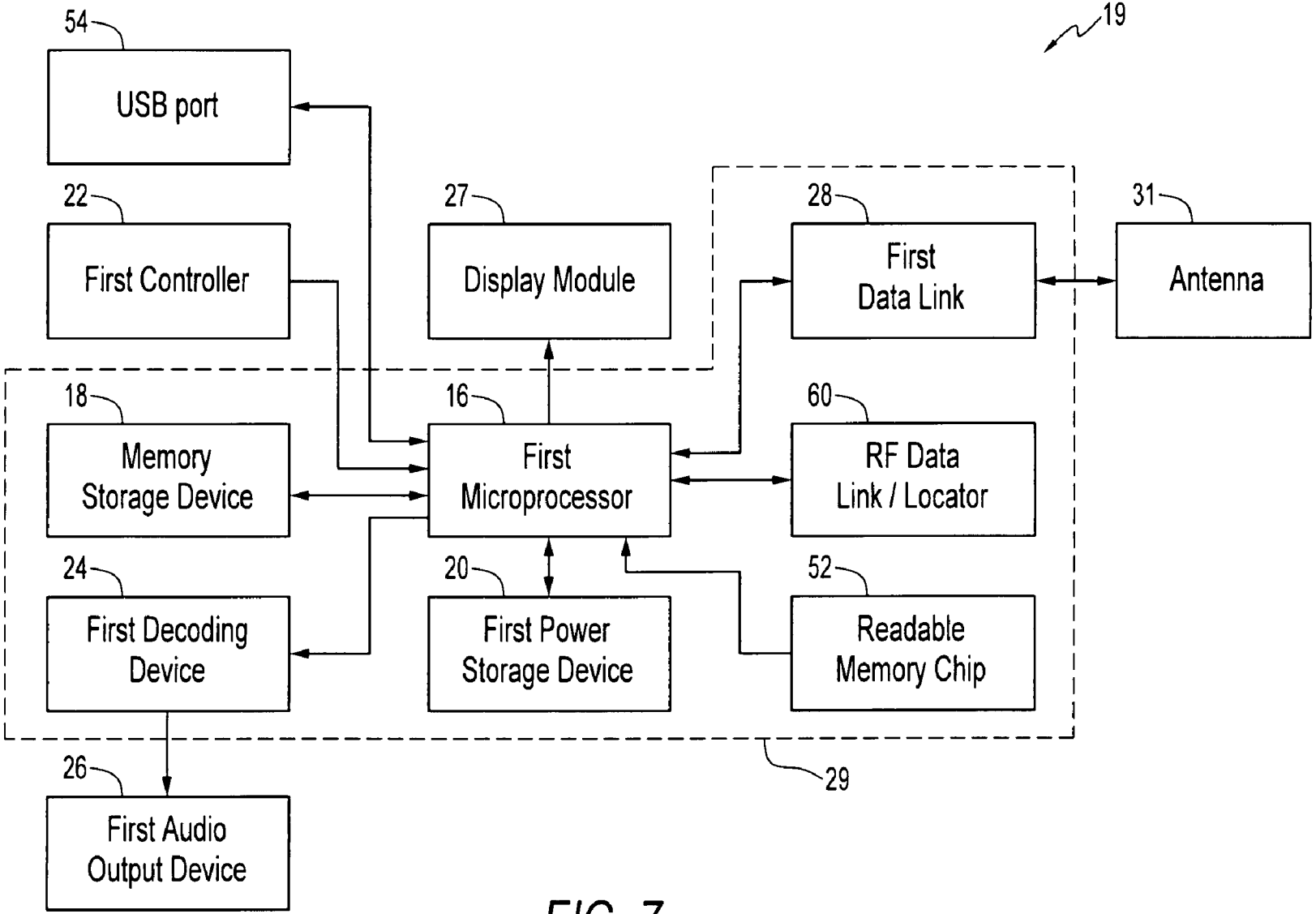
FIG. 7 is a logic diagram showing a sixth embodiment of the data system having a person locating positing device.

A sixth embodiment of the data system is designated 19 and is shown in FIG. 7. The apparatus of the sixth embodiment includes the first electronic module 29 with the addition of a radio frequency ("RF") data link/locator 60. The radio frequency data link/locator 60 is in electronic communication with the first microprocessor 16. The data link/locator 60 acts as a tracker, enabling a remote person (e.g., parent) to determine the location of the user wearing the shoes 12, 14 (e.g., child). When the locator 60 is in use, the location information is transmitted either via USB port 54 or first data link 28 to another computing device, such as a personal computer, personal data assistant (PDA), mobile telephone or other device with compatible software, allowing the remote person to pinpoint the shoe wearer's exact location. However, it is recognized that other ways of transmitting location data are available, as known in the art.

Figure 10:
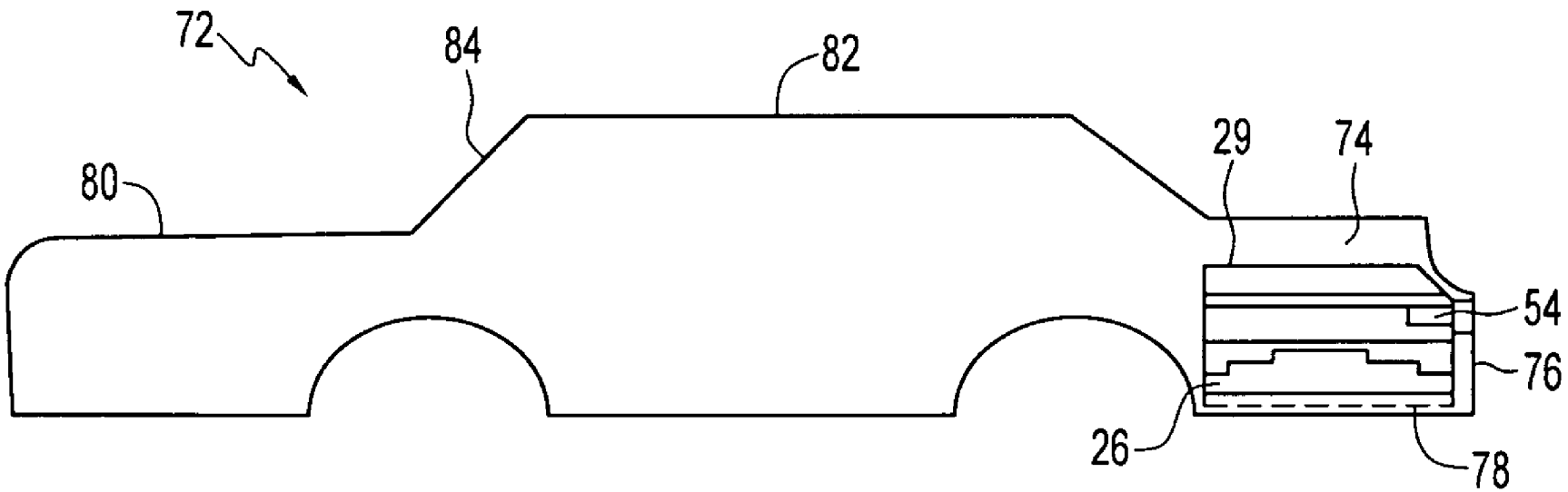
FIG. 10 is a cross-section of a seventh embodiment of the data system showing incorporated into model car.
Figure 11:
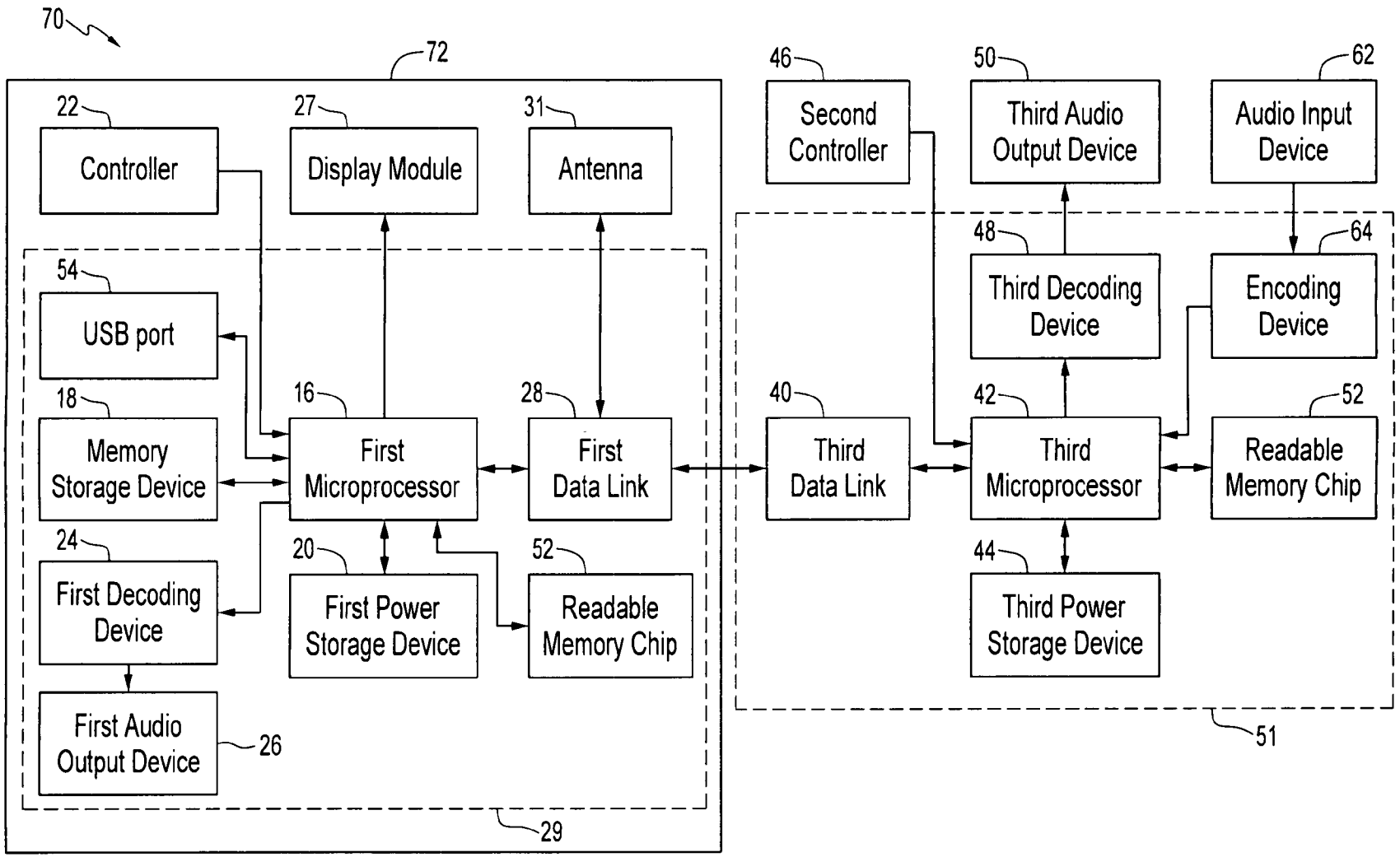
FIG. 11 is a logic diagram showing the operation of the data system in FIG. 10.

FIGS. 10 and 11 illustrate a seventh embodiment of the data system, which is designated 70 and is configured for being utilized in a novelty item, such as a die cast model car 72. The data system 70 includes the first electronic module 29. In the data system 70, the first electronic module 29 further includes the first audio output device 26 and the USB port 54. Preferably, the electronic module 29 is removably secured in a trunk 74 of the model car 72, although other locations may be suitable, such as in the hood or passenger section of the model car. The electronic module 29 is arranged within the trunk 74 such that the USB port 54 is accessible from a rear end 76 of the vehicle 72. Alternatively, the USB port can be located in other parts of the model car. Further, a bottom side 78 of the electronic module 29 is preferably perforated, such that audio output (i.e., music, for example) from the audio output device 26 can be heard. The data system 70 operates similar to the data system 13 fully described above, and accordingly will not be described again.

The data system 70 further includes the first controller 22, which is preferably located on a front hood 80 or on a roof panel 82 of the die cast model car 72, although other locations may be suitable, depending on the application. The display module 27 can be provided on the model car 72, and preferably on a windshield 84 or other location easily accessible to the user. Finally, the data system 70 includes the antenna 31 in communication with the first data link 28, as known in the art. If the user wishes to privately listen to the audio data, the headset 51 can be utilized as described above with reference to the other embodiments.

An eighth contemplated embodiment of the data system is configured for use with an article of clothing (not shown). Although other configurations may be appropriate, the data system for clothing includes the first electronic module 29, which is received in a corresponding pocket or the like (not shown) of the clothing. Similar to the previous discussed embodiments, the electronic module is either in wired communication with an audio output device provided on the article of clothing, or with the wireless headset 51 described in detail below. It is also contemplated that when utilizing the data system in the clothing, the user can obtain heart rate and other additional workout or GPS information.

While particular embodiments of the portable data system have been described herein, it will be appreciated by those skilled in the art that changes and modifications may be made thereto without departing from the invention in its broader aspects.

The invention claimed is:

1. A data system for an article, comprising:

an article;

an electronic module carried by said article, said electronic module having a microprocessor and a data storage device for selectively storing and retrieving data;

a data input to said electronic module configured for inputting and storing data on said data storage device;

a controller in electronic communication with said electronic module for controlling data output; and an audio output device in electronic communication with said electronic module for receiving data output from said electronic module;

wherein said article is a pair of shoes including a first shoe and a second shoe, said first shoe carrying said electronic module, said data input, said controller and said audio output device, and said second shoe carrying a second electronic module in electronic communication with said electronic module and a second audio output device in electronic communication with said second electronic module.

2. The data system according to claim 1, wherein said data comprises stereo music data, and said electronic module is configured to output a first channel to said audio output device and said second electronic module is configured to output a second channel to said second audio output device.

3. The data system as in claim 1 wherein said electronic communication between said second electronic module and said electronic module comprises a wireless data link.

4. A data system for an article of footwear, comprising:

a pair of shoes comprising a first shoe and a second shoe;

a first electronic module carried by said first shoe, said first electronic module having a microprocessor, a data storage device, and a first wireless data link;

a second electronic module carried by said second shoe, said second electronic module having a second wireless data link receptive of data from said first electronic module;

a first audio speaker carried by said first shoe and in electronic communication with said first electronic module; and a second audio speaker carried by said second shoe and in electronic communication with said second electronic module.

5. A data system as in claim 1, further comprising:

a data input for inputting stereo music data to said first electronic device, said system configured to output a first channel of said stereo music data to said first audio speaker and output a second channel of said stereo music data to said second audio speaker.

* * * * *